United States Patent [19]

Bishop

[11] Patent Number: 4,854,807

[45] Date of Patent: Aug. 8, 1989

[54] FREIGHT CONTAINER LIFTING MEANS

[75] Inventor: Frank W. Bishop, Norwich, England

[73] Assignee: George Blair Public Limited Company, Newcastle upon Tyne, England

[21] Appl. No.: 141,409

[22] Filed: Jan. 4, 1988

[51] Int. Cl.[4] ..... B60P 1/64

[52] U.S. Cl. ..... 414/498; 294/812; 294/81.21; 414/607; 414/546

[58] Field of Search ..... 414/498, 499, 546, 547, 414/555, 607; 294/81.2, 81.21

[56] References Cited

U.S. PATENT DOCUMENTS

| | | | |
|---|---|---|---|
| 3,237,967 | 3/1966 | Anderson | 414/498 X |
| 4,166,712 | 9/1979 | Öberg | 414/458 X |
| 4,231,709 | 11/1980 | Corsetti | 414/458 |
| 4,452,555 | 6/1984 | Calabro | 414/458 X |

FOREIGN PATENT DOCUMENTS

| | | | |
|---|---|---|---|
| 8303331 | 4/1985 | Netherlands | 414/498 |
| 1318416 | 5/1973 | United Kingdom | 414/607 |

*Primary Examiner*—Robert J. Spar
*Assistant Examiner*—Robert S. Katz
*Attorney, Agent, or Firm*—Abelman Frayne Rezac & Schwab

[57] ABSTRACT

An adaptor for a hook-lift vehicle provided with a hydraulically-operated lifting mechanism on its chassis to load and unload freight containers having conventional corner fittings, the adaptor comprising an adaptor frame for attachment to the lifting mechanism and including releasable securing members for co-operation with the end corner fittings of a container to secure the frame to the container, and a pair of pivotal, laterally-spaced support surfaces for location one to each side of the rear end of the chassis whereby, subsequent to securing the adaptor frame to the front of a container on the ground and on actuating the lifting mechanism, the front of the container is drawn upwardly onto the chassis until the outer lower side regions of the container engage the support surfaces, continued actuation of the lifting mechanism drawing the container over the pivoting surfaces and onto the chassis.

7 Claims, 3 Drawing Sheets

FREIGHT CONTAINER LIFTING MEANS

BACKGROUND OF THE INVENTION

This invention relates to freight container lifting means and more part culary to such means for lifting and transporting I.S.0. freight containers without the need to pre-load the containers onto a dedicated intermediate supporting system prior to loading of the container onto transportation vehicles.

Freight containers are produced in a series of standard sizes, usually 8 feet in width by 20 feet, 30 feet or 40 feet in length and of height between 4 feet and 8.5 feet, and are known as I.S.0. containers.

These containers are provided with corner fittings in the faces of which are formed generally rectangular openings in which can be received releasable securing means, commonly known as twistlocks, whereby the containers can be secured together or secured to a chassis or platform of a transporting vehicle, it being well-established practice to transport a plurality of such containers on a common platform provided with appropriately located securing means for co-operation with the corner fittings of the containers thereon.

There may, however, be a requirement to transport individual freight containers, for example for munitions purposes, and it would clearly be impractical to utilise multi-container transport means for such purposes.

It is, however, well established practice to provide various types of hook-lift, self-loading and unloading vehicles, commonly known as 'swap-body' vehicles, that are capable of loading, unloading and transporting various shapes and sizes of skips and like containers.

More particularly, such a vehicle is provided with a hydraulically-operated lifting mechanism that includes a hook adapted to be attached to a suitably positioned lifting bar or recess on the container to be handled, whereby said container can be raised onto or unloaded from the vehicle chassis without the necessity for an intermediate pallet or platform.

Such containers must therefore be provided with the appropriate hook-receiving means thereon before they can be loaded or unloaded by such lifting mechanisms.

Further, and if there are no intermediate pallets involved, the underside of the floors of such containers are provided with longitudinally extending strengthening rails or the like which co-operate with rollers on the rear end of the vehicle chassis during loading and unloading of the containers onto the chassis, the loading forces being exerted through said rails and rollers.

Conventional I.S.0. containers are not provided with attachment means suitable for receiving the hooks of such lifting mechanisms, nor are they provided with such long itudinally-extending rails on the undersurfaces thereof.

Thus the existing hook-lift vehicles are not immediately suited to handling I.S.0. containers other than through intermediate pallets.

SUMMARY OF THE INVENTION

It is an object of the invention to be able to utilise conventional hook-lift vehicles to handle I.S.0. containers without the necessity of altering the containers themselves and without having to provide an intermediate loading pallet or platform.

According to the present invention there is provided means for adapting a hook-lift vehicle, having a hydraulically-operated lifting mechanism on the chassis thereof, to load and unload freight containers having conventional corner fittings at the corners thereof, the means comprising an adaptor frame for attachment to, to be movable by, the lifting mechanism, said adaptor frame including releasable securing means thereon for co-operation with the corner fittings of one end of a freight container whereby said frame can be secured to said container, and a pair of laterally-spaced support surfaces for location at or adjacent the rear end of the vehicle chassis one to each side of said chassis, said surfaces being pivotal about a substantially horizontal axis extending transversely of the chassis and being spaced apart by a distance substantially equal to the width of the container, the arrangement being such that, subsequent to securing of the adaptor frame to the front end of a container on the ground and on actuation of the lifting mechanism, the front end of the container is drawn upwardly and forwardly relative to the vehicle chassis until the outer lower side regions of the container engage said opposed support surfaces, the floor of the container and the support surfaces making an acute angle with the horizontal, continued actuation of the lifting mechanism drawing the container over said pivoting surfaces and onto the chassis.

Preferably the adaptor frame comprises a body portion including means thereon for attachment of the hook of the lifting mechanism, and a pair of opposed, releasable securing means, conveniently twistlocks, for co-operation one with each of the two lower corner fittings of the one end of a freight container, the frame further comprising a pair of adjustable arm members each of which is pivotally mounted, at or adjacent one end thereof, to the body portion and the other end of each of which carries a further releasable securing means, again conveniently a twistlock, for co-operation one with each of the two upper corner fittings at the one end of the said container.

The arm members are adjustable such that the securing means carried thereby can be positioned to co-operate with corner fittings at various locations, thus enabling the adaptor frame to be secured to containers of differing heights.

In one embodiment of the invention, the arm members are each mounted to the body portion at a pivot point adjacent one end thereof to be pivotal about said pivot point and movable axially of the arm member relative to said pivot point.

In an alternative embodiment of the invention, each arm member comprises telescopically interconnected portions, the free end of one telescopic portion being pivotally mounted to the body portion and the free end of the other telescopic portion carrying a further releasable securing means.

The pivotal support surfaces are conveniently mounted on outriggers adapted to be secured to the vehicle chassis such that said surfaces are laterally spaced each to receive thereon the associated lower side regions of the container being handled whereby the load of said container is distributed over said surfaces during drawing of the container onto the vehicle chassis.

Each surface may comprise a low friction slider plate over which the container moves as it is drawn onto the vehicle chassis, or, alternatively, said surface may comprise the upper run of a continuous belt, preferably of high friction material, and adapted to move with the container on said drawing of the container onto the vehicle.

Preferably the adaptor means includes releasable securing means associated with each support surface such that, with a container loaded on the vehicle chassis and with the rear end of the container located on said surfaces, said releasable securing means, conveniently twistlocks, can be moved to an operative position projecting through said surfaces and co-operating with the lower corner fittings of the rear end of the container to secure said end of the container to the chassis.

The adaptor means may further comprise a pair of laterally-spaced support surfaces fixed at or adjacent the front regions of the chassis and adapted to receive thereon the front end of a container in its loaded position on the vehicle chassis.

The fixed support surfaces may be apertured whereby associated releasable securing means, conveniently twistlocks, can extend therethrough to co-operate with the lower corner fittings of the front end of the loaded container to secure said end of the container to the chassis.

DESCRIPTION OF THE PREFERRED EMBODIMENT

Figure 1:
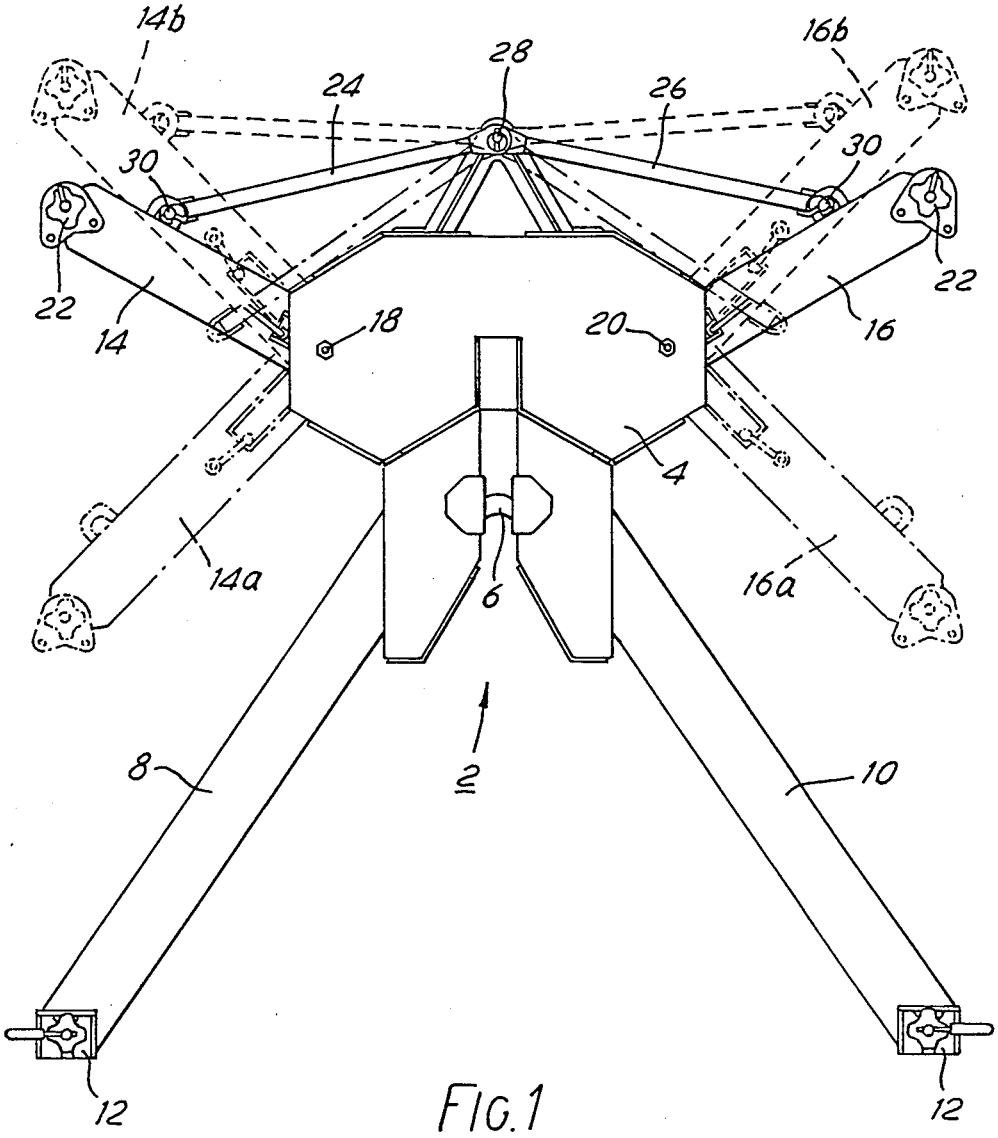
FIG. 1 shows an adaptor frame of adaptor means according to the invention.

Referring to the drawings, the illustrated adaptor means comprises an adaptor frame indicated generally at 2 and including a central body portion 4 provided with a lifting hook bar 6. A pair of arms 8,10 are rigidly secured to, to extend downwardly and outwardly from, the body portion 4, the free end of each arm 8,10 carrying a twistlock 12, the twistlocks 12 being spaced 8 feet apart for co-operation with the lower corner fittings of any standard I.S.0. container.

A pair of upper arms 14,16 are each mounted to the body portion 4 to be pivotal relative thereto about associated pivot points 18,20, each arm 14,16 being provided with a slot therein in which the pivot points 18,20 are received whereby each arm 14,16 can also move axially thereof relative to the associated pivot point 18,20 and to the plate portion 4.

The free ends of the arms 14,16 are each provided with a twistlock 22.

The combination of the pivotability of the arms 14,16 about the pivot points 18,20 and the slidability of said arms relative to their pivot points enables the twistlocks 22 thereon to be located at positions which align with the upper corner fittings of an I.S.0. container of any standard height.

More particularly the arms shown in dotted lines at **14*a*, and 16*a* are positioned to suit, typically, a 4 feet high container, while those shown in dotted lines at 14*b* and 16*b*** are positioned to suit, typically, a container 8 feet 6 inches high.

A pair of removable, rigid stays 24,26 may extend between the body portion 4 and each arm 14,16, one end of each stay being pivotally mounted at 28 to the body portion 4 and the other end of each stay being pivotally mounted at 30 to the associated arm. The pivotal mountings at 30 are each such as to permit limited linear movement of the arms 14,16 relative to the associated stays 24,26. The stays 24,26 serve to support the arms 14,16 in their uppermost positions above the horizontal and therefore assist an operator when locating the twistlocks 22 in the upper corner fittings of the associated container. The relative movement available at the pivot points 30 between the arms 14,16 and the stays 24,26 enables the twistlocks 22 to be accurately positioned for different height containers—the arms 14,16 are shown in position for, typically, a container 7 feet 6 inches high.

Figure 2:
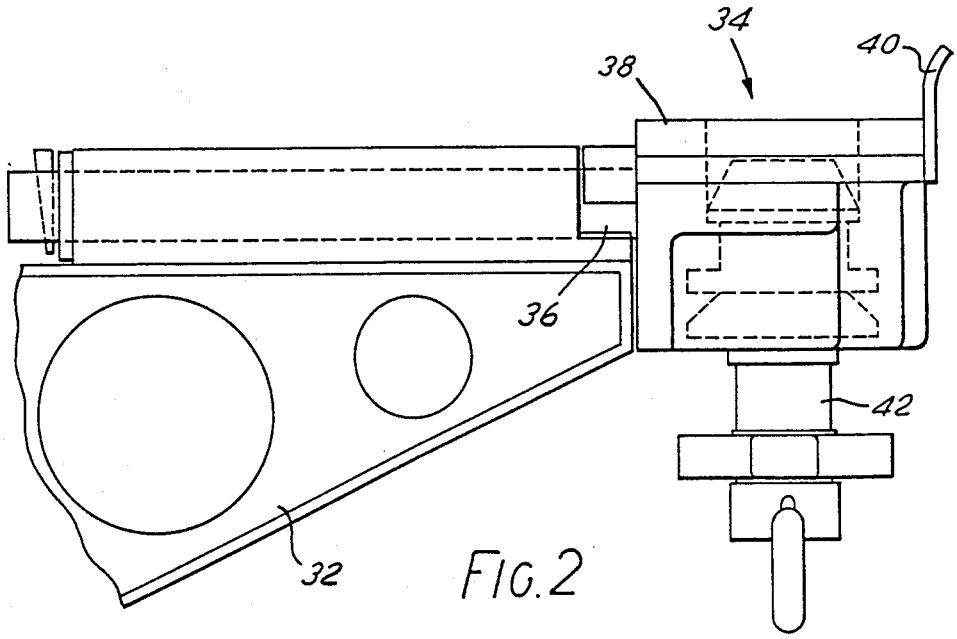
FIG. 2 is an end view of a support surface and associated mechanism of adaptor means according to the invention.
Figure 3:
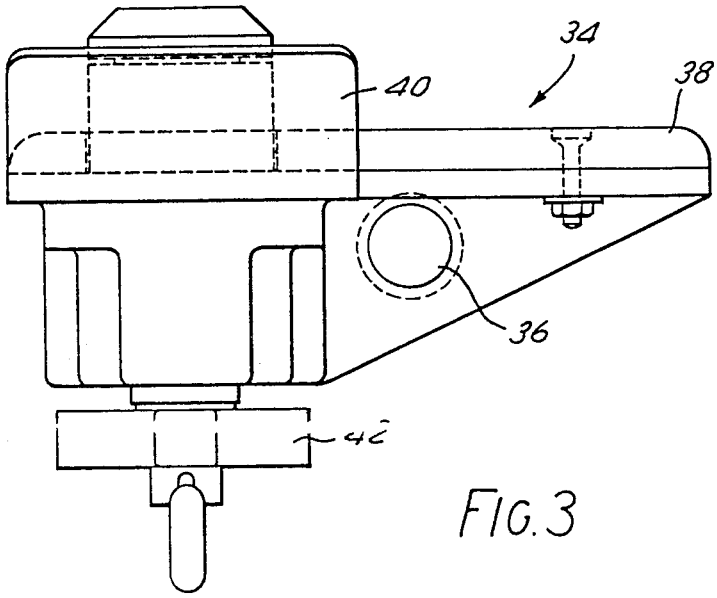
FIG. 3 is a side view of the support surface of FIG. 4.

The adaptor means further comprises a mirror image pair of outrigger side plate assemblies as shown in FIGS. 2 and 3, one for location to each side of the rear end of the chassis of the associated transportation vehicle.

The illustrated assembly includes an outrigger 32 which is designed to suit the particular vehicle, the outer ends of the opposed outriggers being spaced apart to accept the standard 8 foot width of I.S.0. container. Each outrigger is fitted with a container support mechanism 34 pivotal relative to the outrigger on a shaft 36, the support mechanism including a slider plate 38 forming a support surface of low friction material such as NYLATRON-GS (trade mark). The slider plate 38 is thus pivotal relative to the outrigger 32 and vehicle chassis about an axis extending transversely of said chassis to accommodate the loading angle of the container as will be detailed below.

The outer edge of the slider plate 38 is equipped with an upright guide plate 40 which ensures proper alignment of the container during loading and unloading.

The surface of the slider plate 38 may comprise low friction material, or may comprise a roller or ball race or a flat belt or the upper run of a continuous belt of high friction material, all such as to allow loads imposed by the combined weight of the container and the carrying vehicle to be spread along the bottom edge of the bottom side rails of the I.S.0. container without deforming or damaging said side rails.

The support mechanism is equipped with a fully retractable twistlock 42 which can be engaged in the bottom aperture of the rear lower corner fitting on the container thereby fully to secure the container to the hook-lift vehicle after the loading operation is completed.

Figure 4:
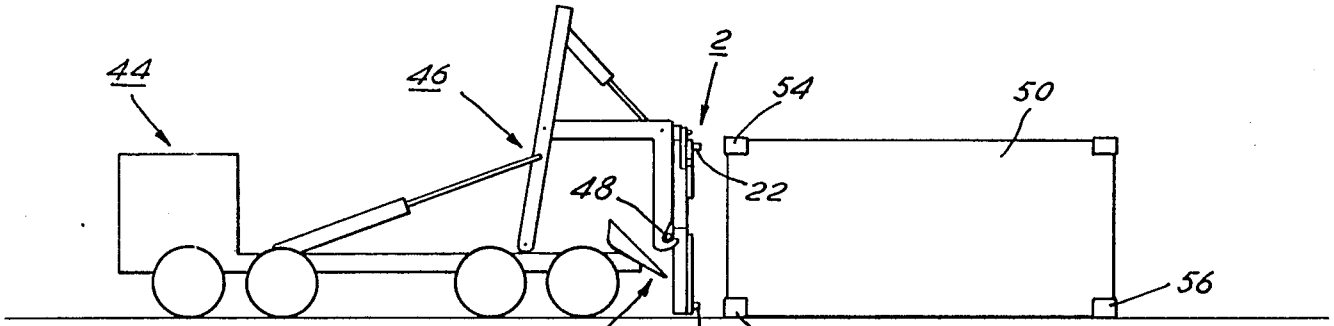
FIGS. 4 and 5 show adaptor means, according to the invention on a hook-lift vehicle in two different positions of the lifting mechanism thereof.

The described apparatus operates as follows with particular reference to FIGS. 4 and 5.

The two rear support mechanisms 34 are manually affixed to the rear outriggers 32 on a conventional hook-lift vehicle indicated generally at 44 and provided with a standard hydraulically-operated lifting mechanism 46 including a lift hook 48.

The adaptor frame 2, which is resting substantially vertically on the ground, is engaged onto the vehicle lift-hook 48 by means of the lifting bar 6, and said frame 2 is then brought into contact with the front end of a container 50 to be loaded resting on the ground.

The pivotal arms 14,16 held by the stays 24,26 are positioned such that the twistlocks 22 are aligned with and engaged into the front apertures of the upper corner fittings 54 of the container 50.

The lower twistlocks 12 are then manually engaged into the front apertures of the bottom corner fittings 52 of the container 50 and are locked therein. Attachment of the frame 2 to the container 50 is completed by locking the upper twistlocks 22 to the corner fittings 54.

The operation of self loading is then identical with that required for the self loading of dedicated hook-lift flatracks, in that the front end of the container 50 is first of all lifted to a level above that of the slider plates 38 with the container pivoting about its trailing edge.

Figure 5:
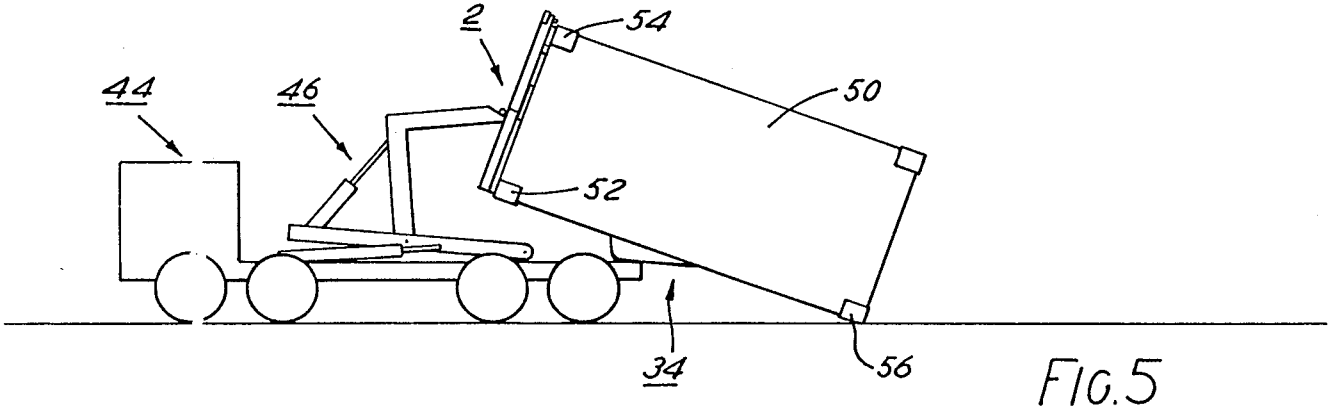

As the lift-hook 48 continues its arc, the vehicle 44 is steered back under the raised container 50 until the slider plates 38 engage the underside of the container and adopt the angle of the floor of the container 50, as shown in FIG. 5. The lift-hook 48 continues its arc as the lifting mechanism 46 draws it forward whereby the container 50 is drawn onto the vehicle chassis and slides along the plate 38, said plates pivoting into a horizontal position as the container 50 is finally loaded onto the chassis.

At completion of loading, the rear of the I.S.0. container 50 is automatically aligned by the guide plates 40, allowing the retractable twistlocks 42 to be manually engaged and locked into the bottom apertures on the lower corner fittings 56 at the rear of the container.

The front of the container 50 is secured to and supported by the vehicle hook-lifting mechanism 46. Alternatively front outriggers with slider plates and retractable twistlocks may be provided, these units being non-pivotal but in all other respects identical with the rear support mechanisms 34.

The precise construction of the adaptor means may vary from that illustrated. For example, the arms 14,16, may comprise telescopically interconnected portions to enable the required variation in the length of the arms to be achieved whereby they can accommodate containers of different heights. Other modifications and variations will be apparent to those skilled in the art.

Thus there are provided adaptor means which enable conventional hook-lift vehicles to handle I.S.0. containers without the necessity of altering the containers themselves and without having to provide an intermediate loading pallet or platform.

What I claim and desired to secure by Letters Patent is:

1. An adapter for a hook-lift vehicle, having hydraulically-operated lifting mechanism on the chassis thereof, to load and unload freight containers having conventional corner fittings at the corners thereof, said adapter comprising:

an adapter frame for attachment to, and movable by, a hook of the lifting mechanism, and including a pair of opposed, releasable securing means for co-operation one with each of the two lower corner fitting of one end of a freight container;

said adapter frame further including a pair of adjustable arm members each of which is pivotally mounted, adjacent one end thereof, to a body portion, of the adapter frame a further releasable securing means for co-operation one with each of the two upper corner fittings at the one end of the container being carried by the other end of each arm member;

said adapter further including a pair of laterally-spaced support surfaces for location adjacent the rear of the vehicle chasis, one on each side of said chassis, said support surfaces being pivotal about a substantially horizontal axis extending transversely of the chasis and being spaced apart by a distance substantially equal to the width of the container;

the adapter arrangement being such that, subsequent to securing of the adaptor frame to the front end of a container on the ground and on actuation of the mechanism, the front end of the container is drawn upwardly and forwardly relative to the vehicle chassis until the outer lower side regions of the container engage said opposed support surfaces, the floor of the container and the support surfaces making an acute angle with the horizontal, continued actuation of the lifting mechanism drawing the container over said pivotable support surfaces and onto the chassis.

2. The adapter as claimed in claim 1 in which the arm members are each mounted to the body portion at a pivot point adjacent one end thereof to be pivotal about said pivot point and to be movable axially of the arm member relative to said pivot point.

3. The adapter as claimed in claim 1 in which the releasable securing means for co-operation with the lower corner fittings at the one end of the container each comprises a twistlock.

4. The adaptor as claimed in claim 1 for a vehicle having outriggers adapted to be secured to the chassis thereof, the pivotal support surfaces being mounted on said outriggers such that said surfaces are laterally spaced each to receive thereon the associated lower side regions of the container being handled whereby the load of said container is distributed over said surfaces during drawing of the container onto the vehicle chassis.

5. The adaptor as claimed in claim 4 in which each support surface comprises a low friction slider plate over which the container moves as it is drawn onto the vehicle chassis.

6. The adaptor as claimed in claim 1 and including releasable securing means associated with each support surface such that, with a container loaded on the vehicle chassis and with the rear end of the container located on said surfaces, said releasable securing means can be moved to an operative position projecting through said surfaces and co-operating with the lower corner fittings of the rear end of the container to secure said end of the container to the chassis.

7. The adaptor as claimed in claim 6 in which the releasable securing means associated with each support surface comprises a twistlock.

* * * * *